US005889448A

United States Patent [19]

Runyan

[11] Patent Number: 5,889,448

[45] Date of Patent: Mar. 30, 1999

[54] RESONATOR MOUNTING MECHANISM

[75] Inventor: Mark W. Runyan, Elgin, Ill.

[73] Assignee: Illinois Superconductor Corporation, Mt. Prospect, Ill.

[21] Appl. No.: 869,399

[22] Filed: Jun. 5, 1997

[51] Int. Cl.[6] ..... H01P 7/00

[52] U.S. Cl. ..... 333/219; 333/995; 248/223.41

[58] Field of Search ..... 333/202, 219, 333/219.1, 235, 12, 995; 248/223.41

[56] References Cited

U.S. PATENT DOCUMENTS

| | | | |
|---|---|---|---|
| 3,775,701 | 11/1973 | Dickens | 331/96 |
| 3,783,418 | 1/1974 | Redwine | 333/188 |
| 4,053,856 | 10/1977 | Fisher et al. | 333/219 |
| 4,384,495 | 5/1983 | Paros | 73/862.59 |
| 4,423,397 | 12/1983 | Nishikawa et al. | 333/219 |
| 4,504,788 | 3/1985 | Froncisz et al. | 324/316 |
| 4,535,308 | 8/1985 | Znojkiewicz | 333/235 X |
| 4,560,965 | 12/1985 | Gosling et al. | 333/219 |
| 4,563,662 | 1/1986 | Thorpe | 333/219 |
| 4,675,691 | 6/1987 | Moore | 343/908 |
| 4,682,131 | 7/1987 | May | 333/202 |
| 4,795,992 | 1/1989 | Saito et al. | 333/206 |
| 4,829,537 | 5/1989 | Baer | 372/66 |
| 4,853,660 | 8/1989 | Schloemann | 333/204 |
| 4,885,559 | 12/1989 | Nakano | 333/12 X |
| 4,892,276 | 1/1990 | Alessio | 248/74.1 |
| 4,972,167 | 11/1990 | Fujioka | 333/12 X |
| 5,030,876 | 7/1991 | EerNisse | 310/353 |
| 5,099,756 | 3/1992 | Franconi et al. | 600/10 |
| 5,291,172 | 3/1994 | Ito et al. | 333/12 X |
| 5,323,129 | 6/1994 | Harris | 333/219.1 |
| 5,435,506 | 7/1995 | Wiley | 248/74.1 |
| 5,604,472 | 2/1997 | Uppaluri et al. | 333/219 |

OTHER PUBLICATIONS

Delayen et al., "Test of a $\beta \cong 0.1$ Superconducting Split Ring Resonator", *IEEE Transactions on Magnetics*, Vol. Mag–17, No. 1, Jan. 1981, pp. 939–942.

Dick et al., "The Split–Loop Resonator as a Superconducting Heavy Ion Accelerating Element", *IEEE Transactions on Magnetics*, Vol. Mag–13, No. 1, Jan. 1977, pp. 512–515.

*Primary Examiner*—Seungsook Ham

*Attorney, Agent, or Firm*—Marshall, O'Toole, Gerstein, Murray & Borun

[57] ABSTRACT

A resonator mounting mechanism includes a stand having a groove in the head of the stand. A cap, which also has a groove, fits over the top of the stand to hold a resonator in place. The stand has two slots formed between lugs, which receive arms on the cap. The sidewalls of the lugs forming the slots and the arms on the cap are tapered so that there is an interference fit between the cap and the stand. The interference fit between the slots and arms holds the cap, stand, and resonator in a fixed position. The bottom of the stand includes structure for attaching the stand to a wall of a resonator cavity, or the like.

15 Claims, 5 Drawing Sheets

RESONATOR MOUNTING MECHANISM

FIELD OF THE INVENTION

The present invention relates generally to devices for holding structures in place, and more particularly to devices for holding a resonant structure to the wall of a resonant cavity.

BACKGROUND OF THE INVENTION

Numerous types of resonant structures, often used in electromagnetic filters, are known in the prior art. For most applications, a conductor and/or dielectric material must be held in a fixed position with respect to a wall, such as the cavity wall of a filter housing. In some resonant structures, conductors are held between slabs of dielectric material which are forced together using screws, springs or adhesive. In many applications, however, it is desirable that a resonator have little physical contact with other objects. Small screws or bolts may be placed through an opening in a resonator such as a dielectric puck, in order to attach the resonator to another structure with minimal physical contact. Although some degradation in performance of the resonator may undoubtedly be attributed to such mounting structures, that degradation is generally small in comparison to other losses which affect the overall quality of the resonator.

The introduction of superconducting materials into resonant structures has significantly decreased the surface resistance of those structures, thereby raising the quality factor "Q" of the filtering devices utilizing the resonant structures. Losses due to mounting, which were previously insignificant, have now become an important limiting factor in the quality of a filter. Prior structures, such as providing a threaded opening or the like in a resonator, may no longer be desirable, because they interfere with the electromagnetic fields at the surface of the resonator. In general, the greater the size of a mounting mechanism or the more contact it has with the resonator, the more likely it will interfere with the electromagnetic properties of the resonator or resonant cavity in which it is used. The desire for reduced size in mounting mechanisms is at odds with the need to hold the resonator at a precise location with minimal chance for mounting failure. In the case of filters using superconductors, the structural demands on the mounting mechanism are increased, since that mechanism will be subjected to temperatures ranging from room temperature to hundreds of degrees below 0° C.

In U.S. Pat. No. 5,604,472, the disclosure of which is incorporated herein by reference, the assignee of the present application used a resonator mounting device having a stand with a groove in the head of the stand surrounded by two wings. A cap with a groove and two wings fit over the head and was attached to the stand by rings. While such a device operates satisfactorily, assembly of the rings onto the wings can be difficult. In certain positions of the stand, it might also be cumbersome to hold the cap to the stand while the rings were applied. In addition, tolerances of the grooves had to be relatively precise or the cap would not hold the resonator to the stand in a fixed position. It is also possible for the resonator to vary in cross-section, resulting in the rings fitting too tightly for assembly or too loosely to clamp effectively once assembled.

SUMMARY OF THE INVENTION

A resonator mounting mechanism for attaching a resonator to a wall or other structure has a stand having a head with a groove formed in the head. A cap has an arm where there is an interference fit between the arm and the head. The cap covers at least a portion of the groove in the head in order to hold the resonant element in the groove.

The head may include a slot with slot sidewalls, and the arm of the cap may have an interference fit with the slot sidewalls. The arm may be tapered, the slot sidewalls may be tapered, and each slot may be open on a side. There may be two arms on the cap and two slots on the head.

The cap may also have a groove. The stand may have a first end, which includes structure for attaching the resonator mounting mechanism to a wall. The stand may also have a second end that includes the head. The groove in the head may have a notch.

In accordance with another aspect of the present invention, a resonator mounting mechanism includes a stand having a head and a cap having an arm. A groove is formed in the cap, and the stand includes means for attaching the resonator mounting mechanism to a wall. The arm has an interference fit with head, and the head covers at least a portion of the groove in order to hold the resonant element in the groove.

DETAILED DESCRIPTION OF THE PREFERRED EMBODIMENT

Figure 1:
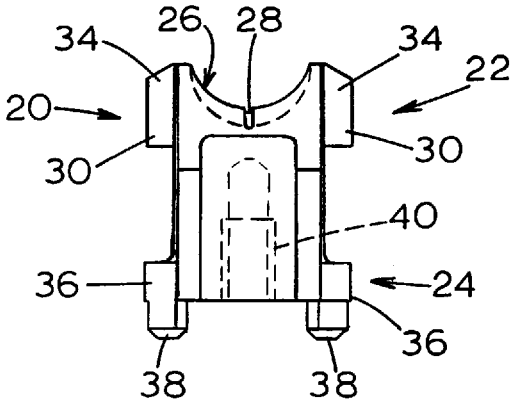
FIG. 1 is an end elevational view of a stand of a resonator mounting mechanism of the present invention.
Figure 2:
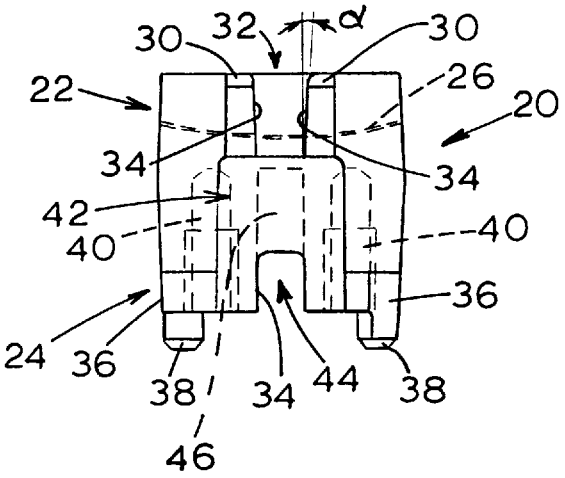
FIG. 2 is a side elevational view of the stand of FIG. 1.
Figure 3:
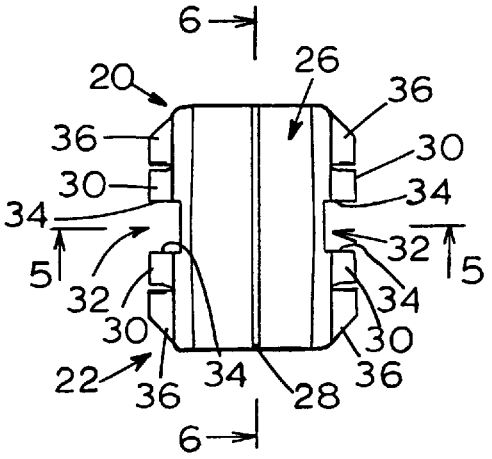
FIG. 3 is a top plan view of the stand of FIG. 1.

Referring initially to FIGS. 1–4, a stand 20 for a resonator mounting mechanism of the present invention includes a head indicated generally at 22, and a base indicated generally at 24. The head 22 includes a groove 26 with a notch 28 at the base of the groove 26 (FIGS. 1 and 3). As best seen in FIG. 1, the groove 26 has a semi-circular cross section in order to accommodate a circular cross-sectioned resonator. As seen in FIG. 2, the groove is curved along its length in order to accommodate a toroidal-shaped resonator as discussed below. If resonators with different cross sections or different shapes are used, the shape and cross section of the groove could, of course, be modified.

On each side of the head 22 there are two lugs 30 which form slots 32 (FIGS. 2 and 3). Each slot 32 is open on one side (as well as on the top and bottom) and is defmed in part by sidewalls 34 on each of the lugs 30. As seen in FIG. 2, the sidewalls 34 are not parallel to each other, but instead are tapered at an angle $\alpha$, which may be approximately 4°.

Figure 4:
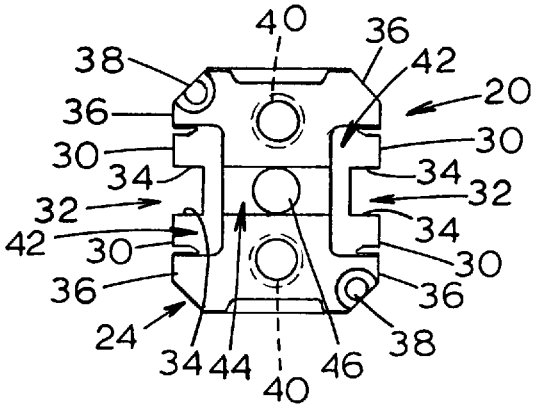
FIG. 4 is a bottom plan view of the stand of FIG. 1.
Figure 5:
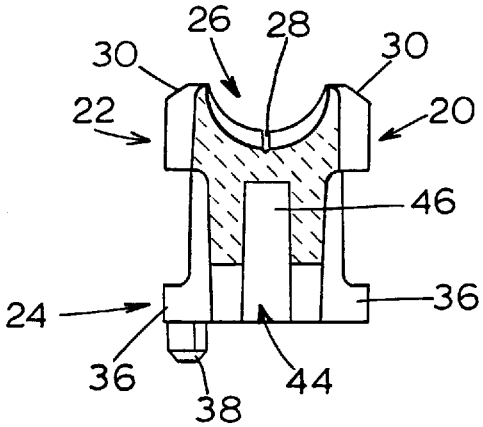
FIG. 5 is a sectional view taken along the line 5—5 of FIG. 3.

Attached to the base 24 of the stand 20 are four legs 36 (FIG. 3), each located at a corner of the base 24. Attached to two of the legs 36 at opposing corners are pegs 38. As best seen in FIGS. 1, 2, and 4, each stand 20 has two threaded openings 40 placed in the base 24 through the bottom of the stand. The threaded openings 40 are used to receive screws in order to attach the stand 20 to a wall. The pegs 38 help to locate the stand properly on such a wall prior to fixing the stand 20 to the wall with screws.

In order to minimize the amount of material used in the stand, several sections of the stand have been eliminated. On each side of the stand 22, just below the lugs 30, sections 42 have had material eliminated (FIGS. 2 and 4). In the center at the bottom of the stand 20, another section 44 has had material eliminated (FIGS. 2, and 4–6). Above the section 44, a cylinder 46 also has no material. Removing material in these locations (or molding the stand without material in those locations) minimizes electromagnetic interference caused by the stand without unduly sacrificing the strength of the stand.

Figure 7:
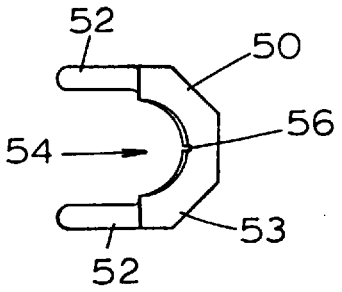
FIG. 7 is a side elevational view of a cap of the resonator mounting mechanism of the present invention.
Figure 8:
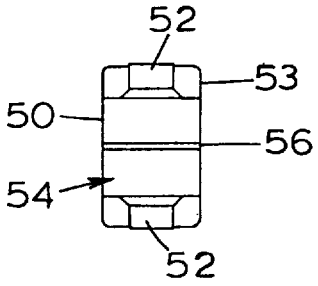
FIG. 8 is a bottom plan view of the cap of FIG. 7.
Figure 9:
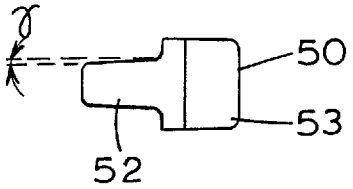
FIG. 9 is an end elevational view of the cap of FIG. 7.

Referring now to FIGS. 7–9, a cap 50 has opposed arms 52 depending from the main portion 53 of the cap. The cap 50 has a groove 54, with a semi-circular cross section (FIG. 7) and a notch 56 at the base of the groove 54. As seen in FIG. 9, the arms 52 are tapered at an angle $\alpha$, which may be approximately 4°.

Figure 6:
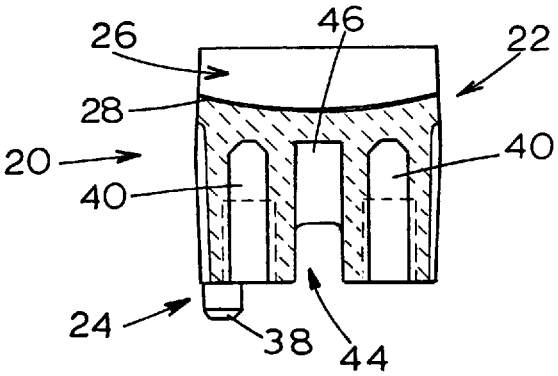
FIG. 6 is a sectional view taken along the line 6—6 of FIG. 3.
Figure 10:
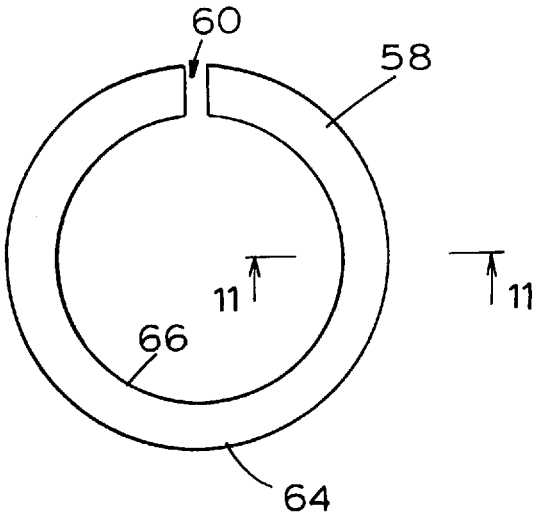
FIG. 10 is a side elevational view of a toroidal split-ring resonant element.
Figure 11:
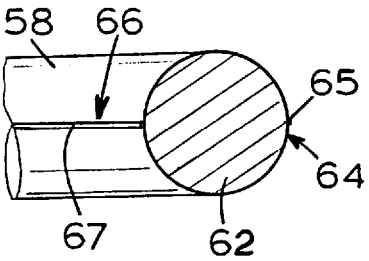
FIG. 11 is an enlarged sectional view taken along the line 11—11 of FIG. 10.

The resonator mounting mechanism of the present invention is designed to hold a resonant element 58 as seen in FIGS. 10 and 11. The resonant element 58 is a toroidal split-ring resonator having a gap 60. The resonant element 58 has a circular cross section 62, which matches the semi-circular cross sections of the groove 26 of the stand 20 and the groove 54 of the cap 50. The resonant element 58 has a curved outer edge 64, which matches the curve of the groove 26 as seen in FIG. 6. The resonant element 58 also has a curved inner edge 66, which matches the curve of the groove 54 of the cap 50 as best seen in FIG. 7. The resonator may be made of or coated with a variety of conductors or superconductors such as copper, silver, or $YBa_2Cu_3O_{7-x}$. It may be desirable to coat the resonator in two steps: first, from outer edge 64 to inner edge 66 on one side of the resonator; and then from outer edge 64 to inner edge 66 on the other side of the resonator. Such a coating method may result in a raised seam 65 on the outer edge 64 and a raised seam 67 on the inner edge 66. The notch 28 in the groove 26 (FIG. 3) and the notch 56 in the groove 54 (FIG. 8) accommodate the seam 65 and seam 67, respectively, to provide contact only between the more precisely curved surfaces of the resonant elements 58 and the surfaces of the stand 20 or cap 50. The notches 28 and 56 normally will not contact the seams 65 and 67 but allow the seams to vary somewhat in width and depth without adversely affecting the amount of contact between the resonant element 58 and the stand 20 or cap 50. The grooves will also help to provide a uniform position for the resonant elements 58, even when the seams vary.

Figure 12:
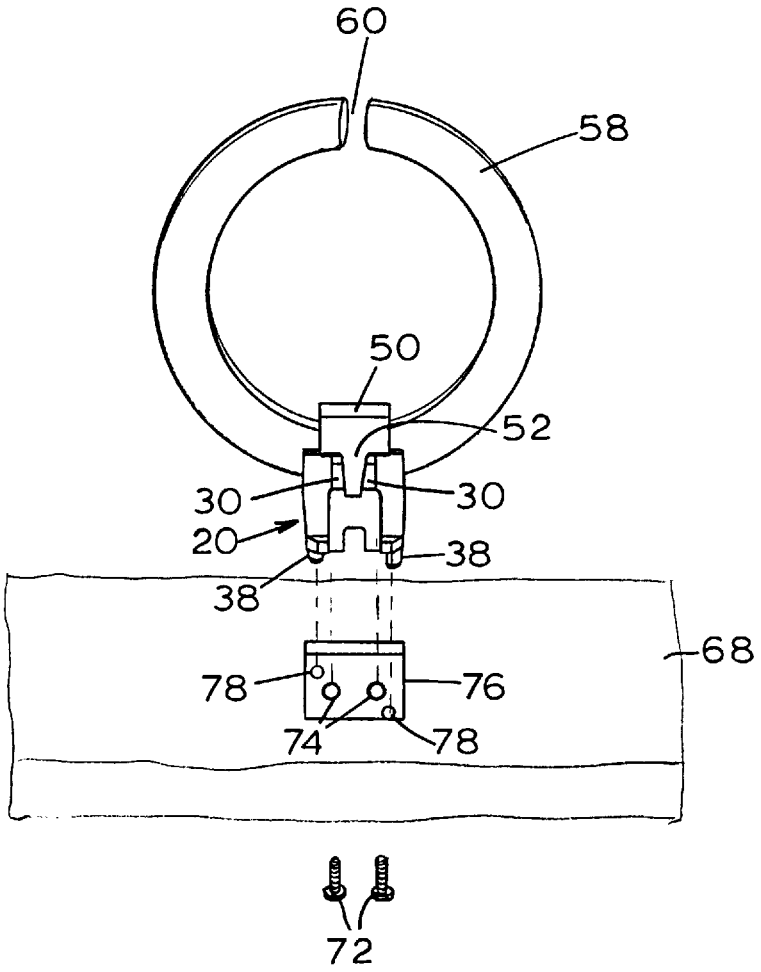
FIG. 12 is an exploded perspective view of a resonator and mounting mechanism attached to a wall of a resonator cavity.

Referring now to FIG. 12, the resonant element 58 is attached to a wall 68 by the resonator mounting mechanism of the present invention. The resonant element 58 is located between the cap 50 and the stand 20 in the respective grooves of the stand 20 and cap 50. The cap 50 is held to the stand 20 because of an interference fit between the arms 52 of the cap 50 and the slots 32 formed between the lugs 30. As the cap 50 is pushed down over the stand 20, the tapering of the arms 52 and of the slot 33 defmed by the lugs 30 creates the interference fit. If the grooves in the cap 50 and stand 20 are properly sized, the resonant element 58 will be held in a stable position once the cap 50 and stand 20 have been forced together.

The stand 20 is attached to an aluminum wall 68 by screws 72, which pass through openings 74 in the wall 68. The openings 74 are located in recess 76 of the wall 68. The recess 76 also has locator holes 78 into which the pegs 38 are inserted. At very cold temperatures, the distance, center-to-center, between the pegs 38 decreases more than the distance between the holes 78 due to the difference in the coefficient of expansion between Ultem and aluminum. That decrease results in rigid engagement between the holes 78 and the pegs 38 to further stabilize the stand 20. Numerous other ways to attach the stand to the wall can be used including adhesive, welding, sonic welding, press fit, locks, or even forming the stand integrally with the wall. It is also not necessary to provide a recess where the stand is attached to the wall, but it may be desirable in order to minimize the penetration of the screws 72 into the cavity containing the resonant element. It may also be desirable to rotate the position of the screws depending on the fields present for a particular resonator.

The cap 50 and stand 20 are preferably made of Ultem, manufactured by General Electric. Ultem is electrically and thermally nonconductive and relatively strong at cryogenic temperatures. If the resonator is made of a superconducting material, strength at such temperatures may be important.

Ordinarily, the resonator cap and stand will be attached together using a fixture to properly align the components. Since the cap may simply be press fit into the stand, assembly is relatively easy even with the limited access which is often provided by a fixture. Once the cap, resonator, and stand are firmly pressed together, an epoxy such as CTD-620 manufactured by Composite Technology Development, Inc. will normally be applied to the cap, resonator, and stand to permanently fix the components in place. Epoxy may be applied to the groove 26 and the groove 54 just prior to assembling the stand 20, resonator 58, and cap 50. A thin film of epoxy bonds the parts together permanently and provides excellent strength. It may be desirable to texture the Ultem parts in order to provide better adhesion with the epoxy.

The interference fit of the cap and stand allows for easy assembly of the resonator mounting mechanism. In addition, the present design helps to minimize the amount of material adjacent the inner edge 66 of the resonant element 58. Electromagnetic fields are highest near the inner edge, and thus most susceptible to distortion, causing a reduction in the quality of the resonator.

Figure 13:
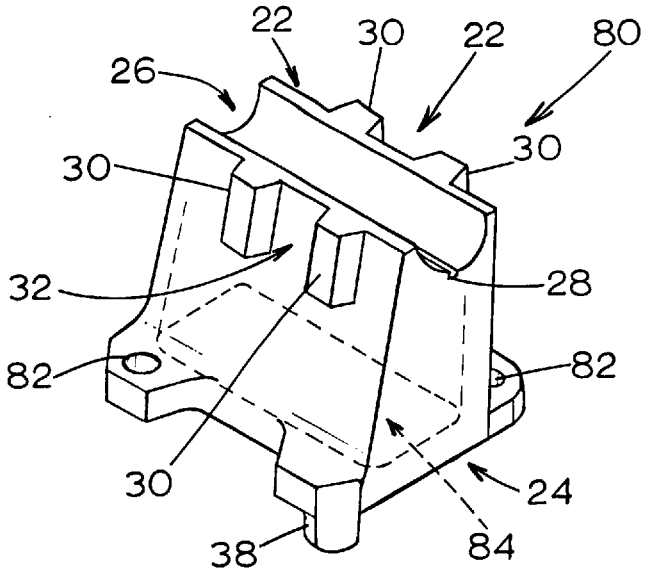
FIG. 13 is a top perspective view of a second embodiment of a stand of a resonator mounting mechanism of the present invention.
Figure 14:
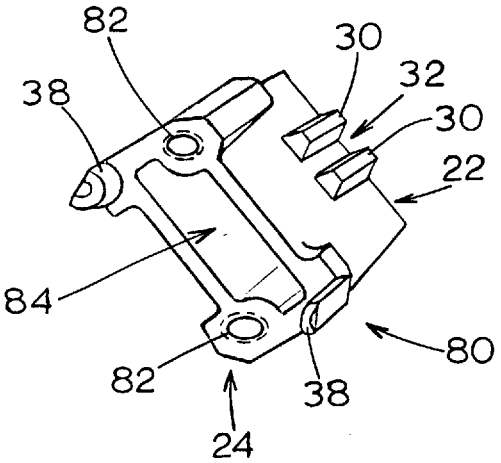
FIG. 14 is a bottom perspective view of the stand of FIG. 13.
Figure 15:
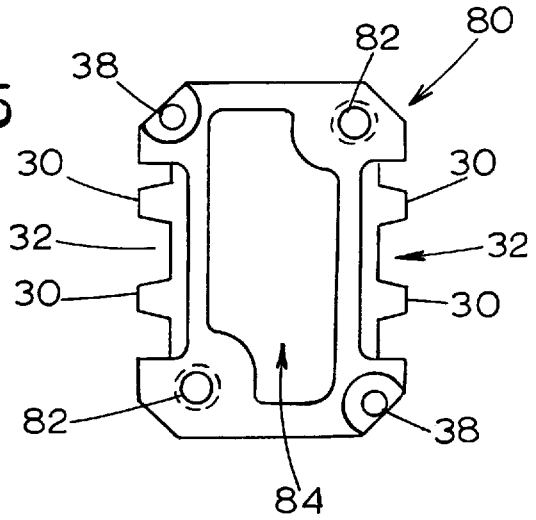
FIG. 15 is a bottom plan view of the stand of FIG. 13.

Referring now to FIGS. 13–15, a second embodiment 80 of a stand of the present invention is depicted. Components of stand 80, which are identical to components of stand 20, have been provided with the same reference numerals. Each stand 80 has a head 22 and a base 24. On each side of the head 22 are a pair of lugs 30 which define a slot 32. The slot 32 receives arms of a cap (not depicted) with an interference fit as previously described. At the corners of the base are pegs 38, which fit into openings in a wall or other structure to which the stand 80 is attached. The other corners of the stand 80 contain threaded openings 82 for receiving screws (not depicted). The openings 82 need not be threaded, but can instead receive screws from the top which are inserted into a threaded opening in the wall. Threads in the wall are also optional if a bolt or other fastening device is used to fix the screw in place.

The entire center of the stand 80 is hollow to form a cavity indicated generally at 84. Material may be removed to form the cavity 84 or the cavity may be molded in the stand initially. Moving all attachment means to the corners and hollowing out the center of the stand 80 may be desirable because it reduces the amount of material in the high magnetic field regions which may be present through the center of the stand 80.

The foregoing detailed description has been given for clearness of understanding only, and no unnecessary limitations should be understood therefrom, as modifications would be obvious to those skilled in the art.

I claim:

1. A resonator mounting mechanism in combination with a resonant element, the mounting mechanism comprising:

a stand having a head;

a groove in the head;

a cap having an arm; and means for attaching the resonator mounting mechanism to a wall;

wherein a direct interference fit is provided between the arm and the head, and the cap covers at least a portion of the groove to hold the resonant element in the groove.

2. The combination of claim 1 wherein:

the head includes a slot with slot sidewalls; and the interference fit is between the arm of the cap and the slot sidewalls.

3. The combination of claim 2, wherein the arm is tapered and the slot sidewalls are tapered.

4. The combination of claim 2, wherein the cap has a second arm and the head has a second slot.

5. The combination of claim 1, wherein the cap has a groove.

6. The combination of claim 1, wherein:

the stand has a first end comprising the means for attaching the resonator mounting mechanism to a wall; and the stand has a second end comprising the head.

7. The combination of claim 1 wherein the groove in the head contains a notch.

8. A resonator mounting mechanism in combination with a resonant element, the mounting mechanism comprising:

a stand having a head;

a cap having an arm;

a groove formed in the cap; and means for attaching the resonator mounting mechanism to a wall;

wherein a direct interference fit is provided between the arm and the head and the head covers at least a portion of the groove in order to hold the resonant element in the groove.

9. The combination of claim 8, wherein:

the head includes a slot with slot sidewalls; and the interference fit is between the arm of the cap and the slot sidewalls.

10. The combination of claim 9, wherein the arm is tapered and the slot sidewalls are tapered.

11. The combination of claim 9, wherein the cap has a second arm and the head has a second slot.

12. The combination of claim 8, wherein the head has a groove.

13. The combination of claim 8, wherein:

the stand has a first end comprising the means for attaching the resonator mounting mechanism to a wall; and the stand has a second end comprising the head.

14. The combination of claim 8, wherein the groove in the cap has a notch.

15. A resonator mounting mechanism in combination with a resonant element, the mounting mechanism comprising:

a first structure having a groove;

a second structure having a protrusion; and means for attaching the mounting mechanism to a wall;

wherein a direct interference fit is provided between the first structure and the second structure to hold the resonant element in the groove.

* * * * *